US011306428B2

(12) United States Patent
Lee et al.

(10) Patent No.: US 11,306,428 B2
(45) Date of Patent: Apr. 19, 2022

(54) LAUNDRY TREATING APPARATUS

(71) Applicant: LG Electronics Inc., Seoul (KR)

(72) Inventors: Kilryong Lee, Seoul (KR); Deukwon Lee, Seoul (KR); Yongdeok Kwon, Seoul (KR)

(73) Assignee: LG Electronics Inc., Seoul (KR)

( * ) Notice: Subject to any disclaimer, the term of this patent is extended or adjusted under 35 U.S.C. 154(b) by 7 days.

(21) Appl. No.: 16/775,926

(22) Filed: Jan. 29, 2020

(65) Prior Publication Data

US 2020/0248387 A1 Aug. 6, 2020

(30) Foreign Application Priority Data

Feb. 1, 2019 (KR) ..... 10-2019-0013734
Apr. 19, 2019 (KR) ..... 10-2019-0046079

(51) Int. Cl.

| | |
|---|---|
| ***D06F 39/14*** | (2006.01) |
| ***D06F 37/20*** | (2006.01) |
| ***D06F 39/02*** | (2006.01) |
| ***D06F 39/08*** | (2006.01) |

(52) U.S. Cl.

CPC ..... *D06F 39/14* (2013.01); *D06F 37/20* (2013.01); *D06F 39/02* (2013.01); *D06F 39/088* (2013.01)

(58) Field of Classification Search

CPC ..... D06F 39/14
See application file for complete search history.

(56) References Cited

U.S. PATENT DOCUMENTS

| | | | |
|---|---|---|---|
| 5,860,300 | A | 1/1999 | Valent |
| 9,045,853 | B2 | 6/2015 | Kim et al. |
| 2011/0083477 | A1 | 4/2011 | Kim et al. |
| 2017/0241060 | A1 | 8/2017 | Seong et al. |

FOREIGN PATENT DOCUMENTS

| | | |
|---|---|---|
| EP | 1690969 | 8/2006 |
| WO | WO2007063072 | 6/2007 |

OTHER PUBLICATIONS

Extended European Search Report in European Application No. 20154951.6, dated Jun. 26, 2020, 9 pages.

*Primary Examiner* — Jason Y Ko
(74) *Attorney, Agent, or Firm* — Fish & Richardson P.C.

(57) ABSTRACT

A laundry treating apparatus include a first fixed body disposed along an circumferential surface of a tub laundry inlet; a second fixed body disposed along a circumferential surface of a cabinet laundry inlet; a first extending body extending from the first fixed body toward the second fixed body; a second extending body extending from the second fixed body toward the first fixed body. A free end of the second extending body is inserted into the first extending body. A connecting body is provided including a first connecting portion extending from the first extending body toward the second extending body; a second connecting portion extending from the second extending body toward the first extending body; and a third connecting portion connecting the first connecting portion with the second connecting portion. A spacer is provided to maintain a spacing between the connecting body and the second extending body.

20 Claims, 5 Drawing Sheets

LAUNDRY TREATING APPARATUS

CROSS-REFERENCE TO RELATED APPLICATIONS

This application claims the benefit of Korean Patent Application No. 10-2019-0013734, filed on Feb. 1, 2019, and Korean Patent Application No. 10-2019-0046079, filed on Apr. 19, 2019, the contents of which are hereby incorporated by reference as if fully set forth herein.

BACKGROUND

Technical Field

The present disclosure relates to a laundry treating apparatus.

Discussion of the Related Art

The laundry treating apparatus includes an apparatus for washing laundry, an apparatus for drying laundry, and an apparatus for washing or drying laundry according to a user's selection. A conventional laundry treating apparatus includes a cabinet equipped with a cabinet laundry inlet, a tub provided inside the cabinet via a damper, a tub laundry inlet disposed in the tub, a drum rotatably provided inside the tub to store laundry therein, and an insulator constructed to connect the cabinet laundry inlet and the tub laundry inlet. The insulator prevents liquid stored in the tub from leaking into the cabinet through the tub laundry inlet, and prevents vibration generated from the tub from being transmitted to the cabinet.

Installation of the insulator requires a space between the tub laundry inlet and the cabinet laundry inlet. The space for the installation of the insulator acts as a limiting factor of a volume of the tub in a laundry treating apparatus with a limited volume of the cabinet. In other words, when the space for installation of the insulator increases, a distance between the cabinet laundry inlet and the tub laundry inlet increases, and thus a length of the tub decreases. This causes a disadvantage that the tub volume is reduced and thus a washing capacity is reduced.

When laundry and water are put into the drum and tub, respectively, the tub sags toward a bottom surface of the cabinet. When the tub sags, a distance between a center of the cabinet laundry inlet and a center of the tub laundry inlet increases. This causes torsion in the insulator. As a result, the insulator disposed in the conventional laundry treating apparatus is vulnerable to breakage due to the torsion.

SUMMARY

A purpose of the present disclosure is basically to solve the problem of the conventional laundry treating apparatus as mentioned above.

A purpose of the present disclosure is to provide a laundry treating apparatus that may minimize wear and breakage of an insulator due to torsion or friction.

Further, a purpose of the present disclosure is to provide a laundry treating apparatus in which when a door opens a laundry inlet, flow of water from a water trap formed between a detergent supply and a tub to an insulator is enviable from an outside.

Purposes of the present disclosure are not limited to the above-mentioned purpose. Other purposes and advantages of the present disclosure as not mentioned above may be understood from following descriptions and more clearly understood from embodiments of the present disclosure. Further, it will be readily appreciated that the purposes and advantages of the present disclosure may be realized by features and combinations thereof as disclosed in the claims.

Particular embodiments described herein include a laundry treating apparatus including a cabinet, a tub, a drum, a first fixed body, a second fixed body, a first extending body, a second extending body, a connecting body, and one or more spacers. The cabinet defines a cabinet laundry inlet. The tub may be configured to receive water and defining a tub laundry inlet facing the cabinet laundry inlet. The drum may be rotatably disposed in the tub and configured to receive laundry therein. The first fixed body may be mounted to the tub and configured to at least partially surround the tub laundry inlet. The second fixed body may be mounted to the cabinet and configured to at least partially surround the cabinet laundry inlet. The first extending body may include a first cylindrical elastic body extending from the first fixed body toward the second fixed body. The second extending body may include a second cylindrical elastic body extending from the second fixed body toward the first fixed body. The second extending body may have a free end configured to be inserted into the first extending body. The connecting body may include first, second, and third connecting portions. The first connecting portion may include a first curved elastic portion extending from a free end of the first extending body toward the second extending body. The second connecting portion may include a second curved elastic portion extending from the free end of the second extending body toward the first extending body. The third connecting portion may include an elastic portion connecting the first connecting portion to the second connecting portion. The spacers may be configured to maintain a space between the connecting body and the second extending body.

In some implementations, the apparatus can optionally include one or more of the following features. The one or more spacers may be positioned vertically below a horizontal plane that includes a rotational axis of the drum. The one or more spacers may include an elastic body configured to contact the second connecting portion, the third connecting portion, and the second extending body. The one or more spacers may be sized to be smaller than or equal to a space between the first connecting portion and the second connecting portion. The one or more spacers may be sized to be smaller than the space between the first connecting portion and the second connecting portion and greater than ½ of the space. At least one of the first fixed body, the second fixed body, the first extending body, the second extending body, the first connecting portion, the second connecting portion, the third connecting portion, or the one or more spacers may be made of rubber. The laundry treating apparatus may include an inflow pipe configured to be connected to the second extending body, a storage disposed in the cabinet and configured to store detergent therein, a detergent outlet configured to discharge the detergent from the storage, and an outflow pipe configured to connect the detergent outlet to the inflow pipe. The output pipe may include a trap defining pipe configured to provide at least one of a P-trap, a U-trap, or an S-trap between the detergent outlet and the inflow pipe. The laundry treating apparatus may include a guide mounted to the second extending body and configured to guide liquid discharged from the inflow pipe toward the tub laundry inlet, a connecting channel configured to connect a storage space to the guide, the storage space defined by the connecting body and the first extending body, and a communication pipe configured to connect the storage space to the tub and permit for liquid inside the storage space to flow into the tub. The connecting channel may include a groove defined in the second connecting portion and configured to guide water to move along a surface of the guide into the storage space. The one or more spacers may include a first spacer positioned on a vertical plane including the rotational axis of the drum, a second spacer positioned at a first side from the vertical plane and spaced apart from the first spacer, and a third spacer positioned at a second side from the vertical plane and spaced apart from the first spacer. The second side may be opposite to the first side with respect to the vertical plane. The second spacer and the third spacer may be symmetrically disposed with respect to the first spacer. The one or more spacers may include a plurality of fourth spacers positioned at the first side from the vertical plane and spaced apart from the second spacer, wherein the plurality of fourth spacers are spaced apart from each other, and a plurality of fifth spacers positioned at the second side from the vertical plane and spaced apart from the third spacer. The plurality of fifth spacers may be spaced apart from each other. The one or more spacers include three or more sixth spacers and three or more seventh spacers. The three or more sixth spacers may be positioned at the first side from the vertical plane and spaced apart from the plurality of fourth spacers. The three or more sixth spacer may be spaced apart from each other. The three or more seventh spacers may be positioned at the second side from the vertical plane and spaced apart from the plurality of fifth spacers. The three or more seventh spacers may be spaced apart from each other. The cabinet may include a door configured to open and close the cabinet laundry inlet. The drum may define a drum laundry inlet facing the tub laundry inlet. The first extending body may define a first inner diameter, and the second extending body may define a second inner diameter being smaller than the first inner diameter.

Particular embodiments described herein include a laundry treating apparatus including a cabinet, a tub, a drum, a first fixed body, a second fixed body, a first extending body, a second extending body, an elastic connecting body, and one or more spacers. The cabinet may define a cabinet laundry inlet. The tub may be configured to receive water and define a tub laundry inlet facing the cabinet laundry inlet. The drum may be rotatably disposed in the tub and configured to receive laundry therein. The first fixed body may be mounted to the tub and configured to at least partially surround the tub laundry inlet. The second fixed body may be mounted to the cabinet and configured to at least partially surround the cabinet laundry inlet. The first extending body may extend from the first fixed body toward the second fixed body. The first extending body may have a first end. The second extending body may extend from the second fixed body toward the first fixed body. The second extending body may have a second end configured to be inserted into the first extending body such that the first end of the first extending body surrounds the second extending body. The elastic connecting body may be configured to connect the first end of the first extending body with the second end of the second extending body. The one or more spacers may be configured to maintain a space between the connecting body and the second extending body.

In some implementations, the apparatus can optionally include one or more of the following features. The one or more spacers may be positioned vertically below a horizontal plane that includes a rotational axis of the drum. At least one of the first fixed body, the second fixed body, the first extending body, the second extending body, or the one or more spacers may be made of rubber. The one or more spacers may include first, second, and third spacers. The first spacer may be positioned on a vertical plane including the rotational axis of the drum. The second spacer may be positioned at a first side from the vertical plane and spaced apart from the first spacer. The third spacer may be positioned at a second side from the vertical plane and spaced apart from the first spacer. The second side may be opposite to the first side with respect to the vertical plane. The second spacer and the third spacer may be symmetrically disposed with respect to the first spacer. The one or more spacers may include a plurality of fourth spacers and a plurality of fifth spacers. The plurality of fourth spacers may be positioned at the first side from the vertical plane and spaced apart from the second spacer. The plurality of fourth spacers may be spaced apart from each other. The plurality of fifth spacers may be positioned at the second side from the vertical plane and spaced apart from the third spacer. The plurality of fifth spacers may be spaced apart from each other.

One aspect of the present disclosure provides a laundry treating apparatus comprising: a first fixed body fixed to a cabinet laundry inlet; a second fixed body fixed to a tub laundry inlet; a cylindrical first extending body extending from the first fixed body toward the second fixed body; a cylindrical second extending body extending from the second fixed body toward the first fixed body; a connecting body connecting the first extending body and the second extending body and having at least two curved surfaces; and a spacer constructed to maintain a spacing between the connecting body and the second extending body.

One aspect of the present disclosure provides a laundry treating apparatus comprising: a cabinet having a cabinet laundry inlet defined therein, wherein a door for opening and closing the cabinet laundry inlet is disposed at the cabinet; a tub having an inner space for storing water therein, wherein the tub has a tub laundry inlet defined in a surface thereof facing the cabinet laundry inlet; a drum disposed rotatably inside the tub and having an inner space for storing laundry therein, wherein the drum has a drum laundry inlet defined in a surface thereof facing the tub laundry inlet; a first fixed body disposed along an circumferential surface of the tub laundry inlet; a second fixed body disposed along a circumferential surface of the cabinet laundry inlet; a first extending body embodied as a cylindrical elastic body extending from the first fixed body toward the second fixed body; a second extending body embodied as a cylindrical elastic body extending from the second fixed body toward the first fixed body, wherein the second extending body has a diameter smaller than a diameter of the first extending body such that a free end of the second extending body is inserted into the first extending body; a connecting body including: a first connecting portion made of an elastic material and extending from a free end of the first extending body toward the second extending body in a curved manner; a second connecting portion made of an elastic material and extending from the free end of the second extending body toward the first extending body in a curved manner; and a third connecting portion made of an elastic material and connecting the first connecting portion and the second connecting portion with each other; and a spacer constructed to maintain a spacing between the connecting body and the second extending body.

In one implementation, the spacer is positioned below a horizontal line passing through a center of the tub laundry inlet.

In one implementation, the spacer is embodied as an elastic body connecting the second connecting portion, the third connecting portion, and the second extending body with each other.

In one implementation, a length of the spacer is set to smaller than or equal to a spacing between the first connecting portion and the second connecting portion.

In one implementation, the length of the spacer is smaller than the spacing between the first connecting portion and the second connecting portion and is greater than ½ of the spacing.

In one implementation, each of the first fixed body, the second fixed body, the first extending body, the second extending body, the first connecting portion, the second connecting portion, the third connecting portion, and the spacer is made of rubber.

In one implementation, the laundry treating apparatus further comprises: an inflow pipe constructed to penetrate the second extending body; a storage disposed in the cabinet to store detergent therein; a detergent outlet to discharge the detergent in the storage; an outflow pipe constructed to connect the detergent outlet and the inflow pipe with each other; and a trap defining pipe as a portion of the outflow pipe, wherein a trap defining pipe defines one of a P-trap, an U-trap, and a S-trap between the detergent outlet and the inflow pipe.

In one implementation, the laundry treating apparatus further comprises: a guide disposed on the second extending body to guide liquid discharged from the inflow pipe toward the tub laundry inlet; a connecting channel for connecting a storage space defined by the connecting body and the first extending body to the guide; and a communication pipe for connecting the storage space to the tub such that liquid inside the storage space flows to the tub.

In one implementation, the connecting channel is embodied as a groove defined in the second connecting portion to guide water moving along a surface of the guide into the storage space.

In one implementation, the spacer includes: a first spacer positioned at a vertical line passing through a center of the tub laundry inlet; a second spacer positioned on a right side to the first spacer and spaced from the first spacer; and a third spacer positioned on a left side to the first spacer and spaced from the first spacer, wherein the second spacer and the third spacer are disposed in positions symmetrical with each other with respect to the first spacer.

In one implementation, the spacer further includes: a fourth spacer located on a right side to the second spacer and spaced from the second spacer; and a fifth spacer located on a left side to the third spacer and spaced from the third spacer, wherein each of the fourth spacer and the fifth spacer includes two or more spacer bodies spaced apart from each other.

In one implementation, the spacer further includes: a sixth spacer located on a right side to the fourth spacer and spaced from the fourth spacer; and a seventh spacer located on a left side to the fifth spacer and spaced from the fifth spacer, wherein each of the sixth spacer and the seventh spacer includes three or more spacer bodies spaced apart from each other.

The features of the above-described implantations may be combined with other embodiments as long as they are not contradictory or exclusive to each other.

Effects of the present disclosure are as follows but are limited thereto:

In accordance with the present disclosure, a laundry treating apparatus that may minimize wear and breakage of an insulator due to torsion or friction may be realized.

Further, on accordance with the present disclosure, a laundry treating apparatus in which when a door opens an laundry inlet, flow of water from a water trap formed between a detergent supply and a tub to an insulator is enviable from an outside may be realized.

Effects of the present disclosure are not limited to the above effects. Those skilled in the art may readily derive various effects of the present disclosure from various configurations of the present disclosure.

DETAILED DESCRIPTIONS

Figure 1:
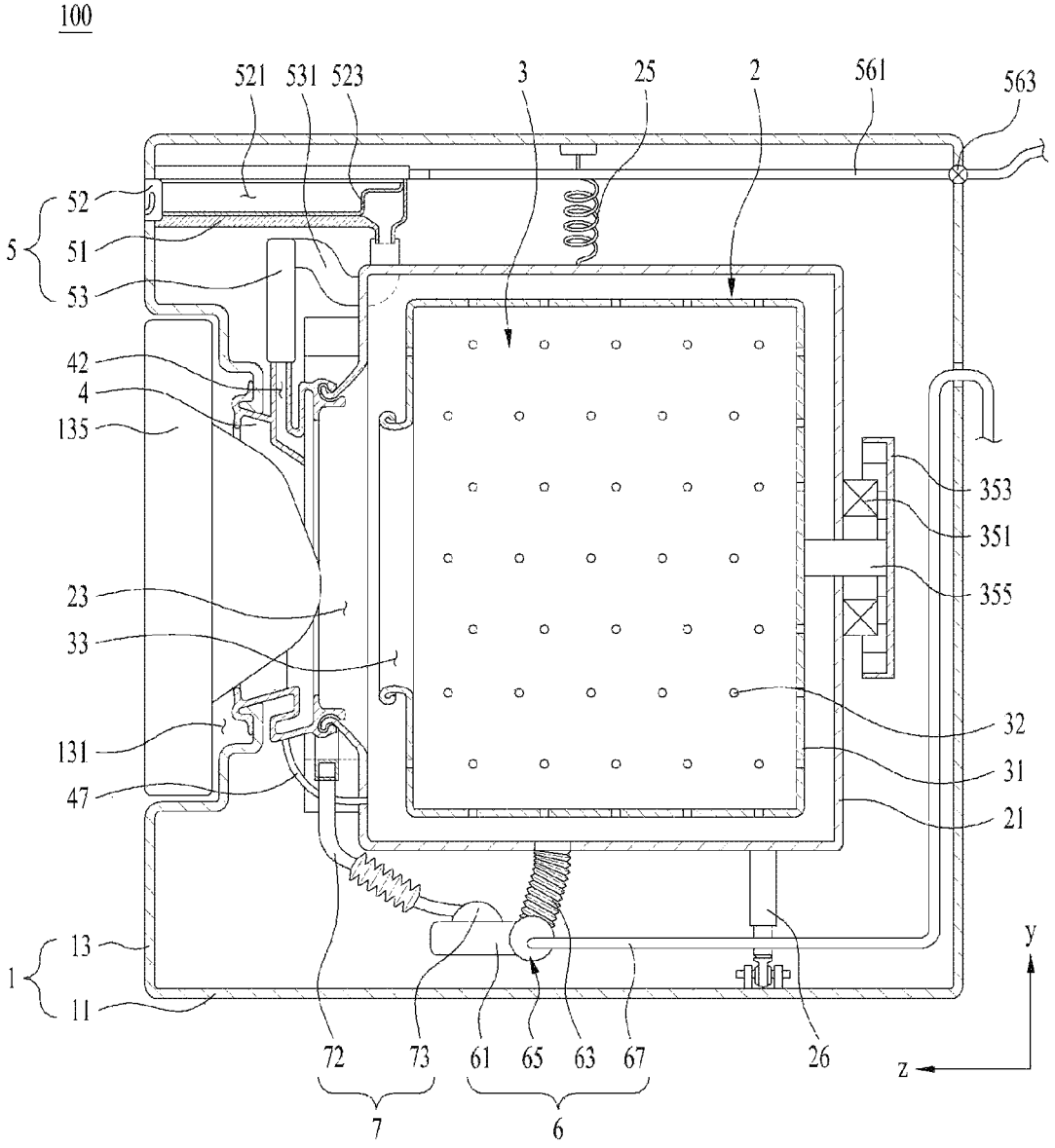
FIG. 1 and FIG. 2 show an example of a laundry treating apparatus.

For simplicity and clarity of illustration, elements in the figures are not necessarily drawn to scale. The same reference numbers in different figures denote the same or similar elements, and as such perform similar functionality. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure.

Examples of various embodiments are illustrated and described further below. It will be understood that the description herein is not intended to limit the claims to the specific embodiments described. On the contrary, it is intended to cover alternatives, modifications, and equivalents as may be included within the spirit and scope of the present disclosure as defined by the appended claims.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises", "comprising", "includes", and "including" when used in this specification, specify the presence of the stated features, integers, operations, elements, and/or components, but do not preclude the presence or addition of one or more other features, integers, operations, elements, components, and/or portions thereof. As used herein, the term "and/or" includes any and all combinations of one or more of the associated listed items. Expression such as "at least one of" when preceding a list of elements may modify the entire list of elements and may not modify the individual elements of the list.

It will be understood that, although the terms "first", "second", "third", and so on may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

In addition, it will also be understood that when a first element or layer is referred to as being present "on" or "beneath" a second element or layer, the first element may be disposed directly on or beneath the second element or may be disposed indirectly on or beneath the second element with a third element or layer being disposed between the first and second elements or layers. It will be understood that when an element or layer is referred to as being "connected to", or "coupled to" another element or layer, it may be directly on, connected to, or coupled to the other element or layer, or one or more intervening elements or layers may be present. In addition, it will also be understood that when an element or layer is referred to as being "between" two elements or layers, it may be the only element or layer between the two elements or layers, or one or more intervening elements or layers may be present.

Unless otherwise defined, all terms including technical and scientific terms used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

A laundry treating apparatus 100 includes a cabinet 1, a tub 2 provided inside the cabinet 1 to store water therein, and a drum 3 rotatably disposed inside the tub for storing laundry therein.

The cabinet 1 has a base 11 forming a bottom face of the laundry treating apparatus, a front panel 13 forming a front face of the laundry treating apparatus, a rear panel forming a rear face of the laundry treating apparatus, a first side panel and a second side panel which are constructed to respectively connect both side faces of the front panel and both side faces of the rear panel to form both side faces of the cabinet, and a top panel to form a top face of the laundry treating apparatus.

The front panel 13 and the rear panel may be fixed to the base 11. The first side panel and the second side panel may be fixed to the base 11 and configured to connect the front and rear panels with each other.

The front panel 13 is equipped with a cabinet laundry inlet 131 which communicates an inside of the cabinet with an outside thereof. The cabinet laundry inlet 131 may be configured to be opened and closed by a door 135 rotatably provided at the front panel 13.

The tub 2 may have a hollow cylindrical tub body 21. A front face of the tub body has a tub laundry inlet 23. The tub laundry inlet 23 is connected to the cabinet laundry inlet 131 via an insulator 4. A specific structure of the insulator will be described later.

Figure 2:
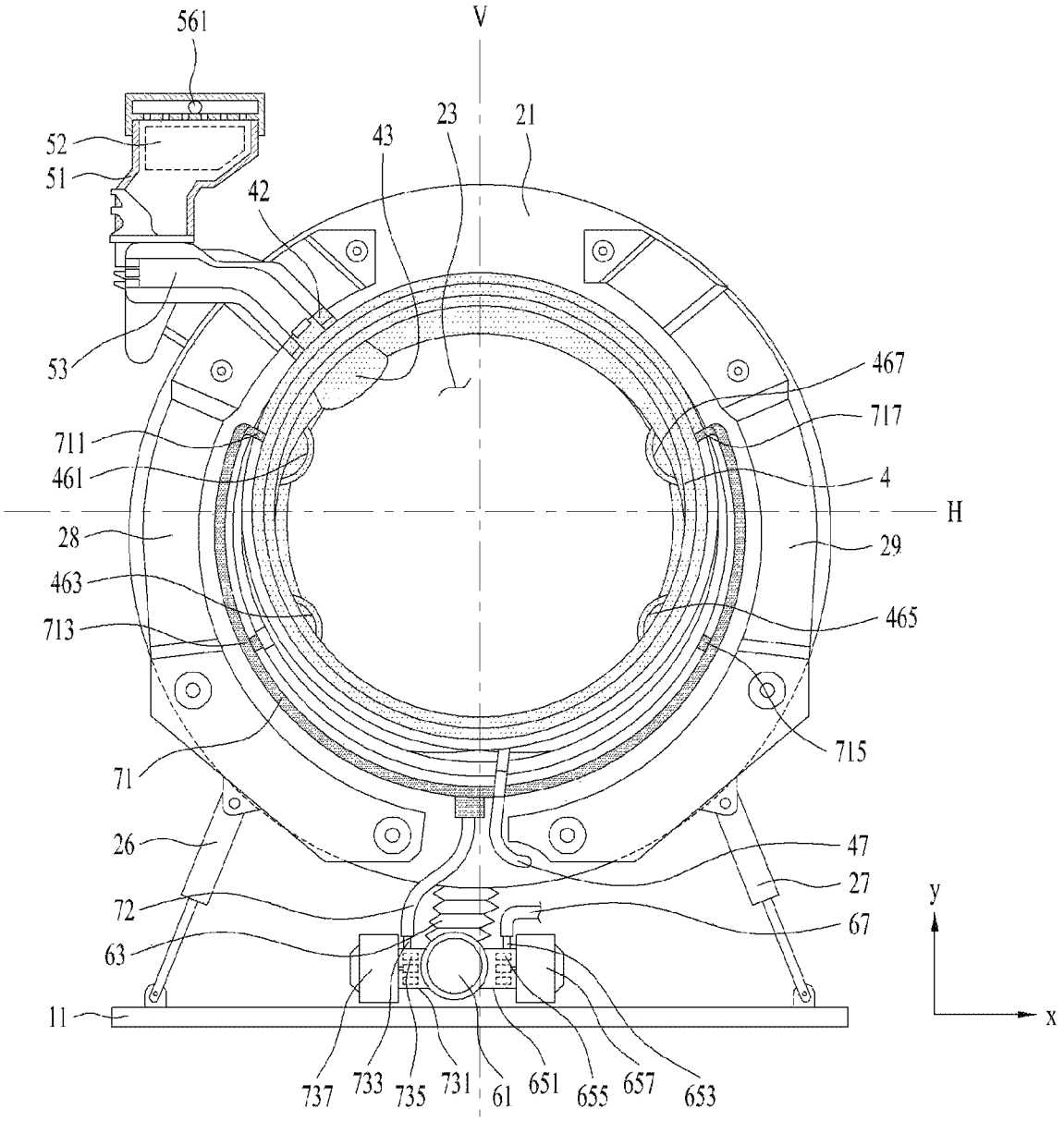

The tub body 21 may be fixedly disposed inside the cabinet 1 via a tub support. As shown in FIG. 2, the tub support may include a spring 25 that secures, to the cabinet 1, a region of a circumferential face of the tub body 21 as located above a horizontal line H passing through a rotation center of the drum, and a damper that secures, to the cabinet 1, a region of the circumferential face of the tub body 21 located below the horizontal line H.

The damper may include a first damper 26 located on a left side of the circumferential face of the tub body 21 to a vertical line V passing through the drum rotation center, and a second damper 27 located on a right side of the circumferential face of the tub body 21 to the vertical line V.

On the front face of the tub body 2, a weight to increase a weight of the tub body 21 may be disposed. The weight may include a first weight balancer 28 fixed in a left portion of a space provided by a front face of the tub body to the vertical line V, and a second weight balancer 29 fixed in a right portion of a space provided by a front face of the tub body to the vertical line V.

Increasing the weight of the tub body 21 using the weight allows the tub body 21 to absorb a large amount of vibration, so that the laundry treating apparatus may minimize transmission of the vibration generated during rotation of the drum 3 to the cabinet.

As shown in FIG. 1, the drum 3 includes a rotatable drum body 31 inside the tub body 21. The drum body 31 has a hollow cylindrical shape. Each of a circumferential face, a front face and a rear face of the drum body 31 has drum through-holes 32 which communicates an inside of the drum body with an outside of the tub body. Further, the drum laundry inlet 33 is defined in a face (front face of the drum) facing the laundry inlet 11 of the space provided by the drum body 31.

The drum body 31 is rotated by a drum driver. The drum driver includes a stator 351 fixed to a back of the tub body 21 to generate a rotating field, a rotor 353 located outside the tub body 21 to rotate using the magnetic field, and a rotation shaft 355 penetrating a rear face of the tub body 2 to connect the rotor 353 and the drum body 31 with each other.

The insulator 4 connecting the cabinet laundry inlet 131 with the tub laundry inlet 23 not only prevents water stored in the tub body 21 from being discharged to the cabinet 1 through the tub laundry inlet 23, but also reduces transmission of the vibration of the tub body 21 to the cabinet.

Figure 3:
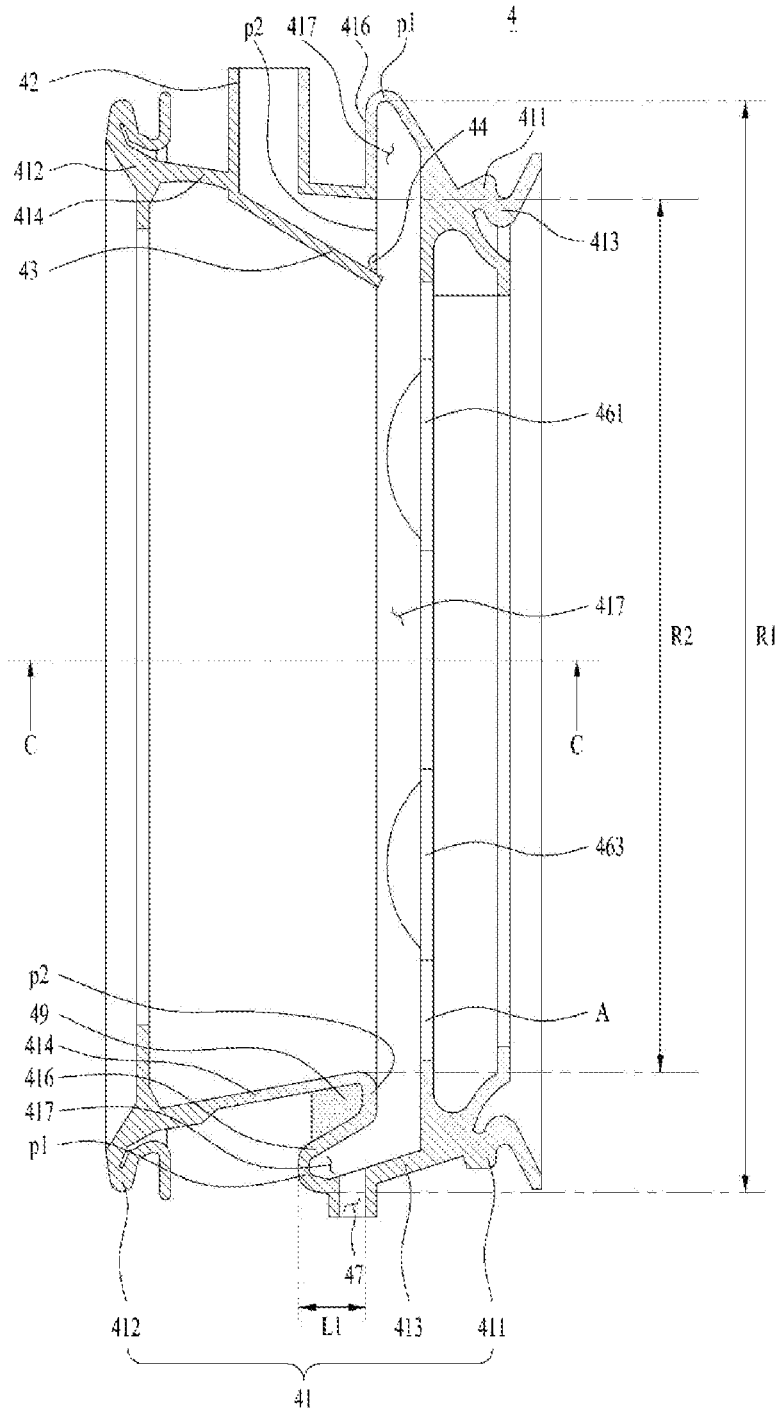
FIG. 3 and FIG. 4 shows an example of an insulator disposed in the laundry treating apparatus.

As shown in FIG. 3, the insulator 4 may be embodied as an elastic body made of rubber, etc. and include an insulating body 41 connecting the cabinet laundry inlet 131 and the tub laundry inlet 23 with each other.

The insulating body 41 may include a ring shaped first fixed body 411 fixed to the tub laundry inlet 23, a ring shaped second fixed body 412 fixed to the cabinet laundry inlet 131, a cylindrical first extending body 413 extending from the first fixed body 411 to the second fixed body 412, a cylindrical second extending body 414 extending from the second fixed body 412 to the first fixed body 411, and a connecting body 416 connecting the first extending body and the second extending body with each other.

A diameter R1 of the first extending body 413 may be set to be larger than a diameter R2 of the second extending body 414. A length of the first extending body 413 and the length of the second extending body 414 may be set such that a free end of the second extending body 414 (an end thereof opposite to the second fixed body) is insertable into the first extending body 413. In order to prevent the vibration of the tub from being transmitted to the cabinet, each of the first extending body 413 and the second extending body 414 is preferably embodied as an elastic body.

Figure 4:
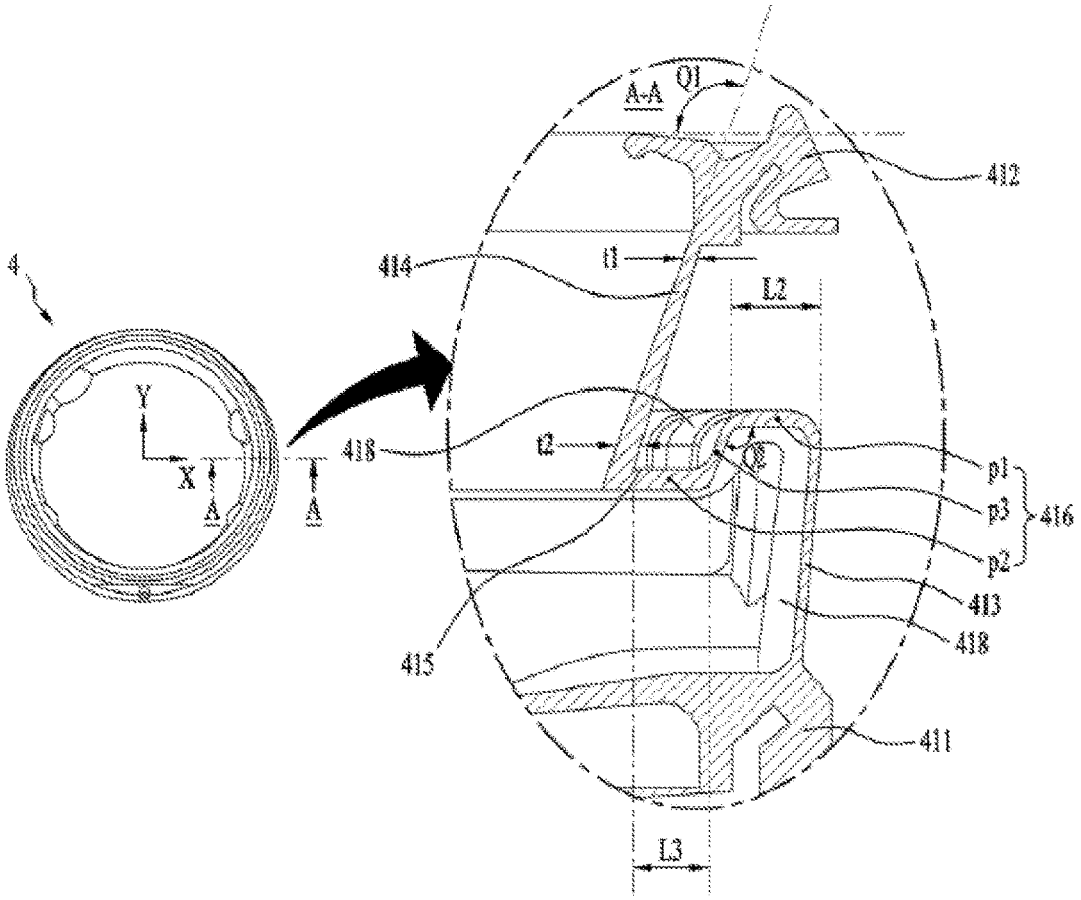

As shown in FIG. 4, the connecting body 416 may have a first connecting portion P1 that is bent from a free end of the first extending body 413 toward the second extending body 414 to form a curved portion (first curved portion) from the first extending body 413, a second connecting portion P2 that is bent from a free end of the second extending body 414 toward the first extending body 413 to form a curved portion (second curved portion) from the second extending body 414, and a third connecting portion P3 connecting the first connecting portion and the second connecting portion with each other. In order to prevent the vibration of the tub from being transmitted to the cabinet, each of the first connecting portion P1, the second connecting portion P2, and the third connecting portion P3 is preferably made of an elastic material.

At least one of the first connecting portion P1 and the second connecting portion P2 may extend to be parallel to a radial (X-axis) direction of the tub laundry inlet 23. FIG. 4 shows an example where both the first connecting portion P1 and the second connecting portion P2 are parallel to a plane formed by the tub laundry inlet 23.

When both of the first connecting portion P1 and the second connecting portion P2 extend to be parallel to the radial direction of the tub laundry inlet 23, this may minimize a spacing between the cabinet laundry inlet 131 and the tub laundry inlet 23 such that the laundry treating apparatus may maximize a volume of the tub body 21.

It may be assumed that the second connecting portion P2 is convex toward the tub laundry inlet 23. In this case, a distance between the second connecting portion P2 and the first fixed body 411 may be smaller, such that the second connecting portion P2 and the first fixed body 411 may rub against each other when the tub 2 vibrates. To avoid this problem, a length (in a Z axis direction) of the first extending body 413 may be larger such that the second connecting portion P2 and the first fixed body 411 are spaced apart from each other. However, increasing the length of the first extending body 413 may cause the tub laundry inlet 23 to be far away from the cabinet laundry inlet 131. As a result, the tub volume decreases. Thus, the washing capacity of the laundry treating apparatus is inevitably reduced.

In one example, the first connecting portion P1 is assumed to have a convex shape toward the cabinet laundry inlet 131. In this case, a distance between the first connecting portion P1 and the front panel 13 is smaller such that the first connecting portion P1 may rub against the front panel 13 of the cabinet when the tub vibrates. To prevent damage of the insulator 4 due to friction between the front panel 13 and the first connecting portion P1, a length of the second extending body 414 should be set to be larger enough to separate the first connecting portion P1 from the front panel 13. This design may cause the volume reduction of the tub.

Thus, when at least one of the first connecting portion P1 and second connecting portion P2 extends in a parallel manner to the radial direction of the tub laundry inlet 23, this may maximize the volume of the tub fixed inside the cabinet with a limited volume.

However, when the insulator 4 having the first extending body 413, the second extending body 414, and the connecting body 416 having the same thickness has the first connecting portion P1 and the second connecting portion P2, the vibration of the tub 2 may concentrate on the second extending body 414.

The vibration of the tub caused by the rotation of the drum 3 is transferred to a contact point between the second extending body 414 and the connecting body 416 through the first extending body 413 and the S-shaped connecting body 416. In this connection, the second extending body 414 is fixed to the cabinet laundry inlet 131 of the front panel 13 which vibrates in a smaller amount than the tub 2 vibrates (because there is no separate structure that may dampen the vibration such as the connecting body). Thus, the vibration of the tub may concentrate on the second extending body 414.

When the vibration concentrates on the second extending body 414 whenever the tub 2 vibrates, the second extending body 414 may tear. For this reason, increasing a thickness of the second extending body 414 may disallow the vibration to be concentrated on the second extending body 414. However, increasing the thickness of the second extending body 414 may cause another problem in which the vibration is concentrated on a contact point (second connecting portion P2) between the second extending body and the connecting body.

Based on an experiment, it is identified that when a thickness of the first extending body 413, a thickness of the first connecting portion P1, a thickness of the second connecting portion P2, and a thickness of the third connecting portion P3 are set to be equal to each other, and as a thickness of the second extending body 414 is set to increase as it extends from the second fixed body 412 toward the second connecting portion P2 ($t2>t1$), the vibration of the tub may be effectively prevented from concentrating on a portion of the insulator 4.

However, when a minimum thickness t1 of the second extending body 414 must be set to be larger than a thickness of the first extending body 413, this may prevent a contact between the second extending body 414 and the second fixed body 412 from tearing or being broken.

In one example, a length of the first connecting portion P1, a length of the second connecting portion P2, and a length of the third connecting portion P3 may be set to be the same. This is to prevent the vibration from concentrating on the connecting portions having different lengths.

Furthermore, an inclination angle Q1 of the second extending body 414 relative to the cabinet laundry inlet 131 and an inclination angle Q2 of the third connecting portion P3 relative to the first connecting portion P1 (or an inclination angle Q2 of the third connecting portion P3 relative to the second connecting portion P2) may be set to be equal to each other.

FIG. 4 shows an example in which the inclination angles Q1 and Q2 are set to the same angle in a range of 110 to 130 degrees. When each of the inclination angles Q1 and Q2 is smaller than 110 degrees, there may be a disadvantage that the vibration is concentrated on contacts points between the connecting portions (both ends of the third connecting portion). When each of the inclination angles Q1 and Q2 is greater than 130 degrees, a bending degree of the connecting body 416 becomes smaller, thereby to cause the disadvantage of decreasing an ability to absorb the vibration.

The insulator 4 disposed in the laundry treating apparatus may further have a rib 418 that increases an strength of the insulating body 41. The rib 418 may be embodied as an elastic body that has a bar shape (a length is larger than a width or height) and protrudes from a surface of the first extending body 413 and a surface of the connecting body 416. The rib 418 may include a plurality of ribs arranged along a circumferential face of the insulating body 41. Unlike the configuration shown in FIG. 4, the rib 418 may be disposed only on the connecting body 416.

Furthermore, when in the laundry treating apparatus, water and laundry are input to the tub and drum respectively and the tub body 21 sags toward the base 11, the connecting body 416 may contact the second extending body 414. Thus, the laundry treating apparatus may further include a spacer to prevent the contact between the connecting body 416 and the second extending body 414 to prevent the insulator 4 from breaking.

Figure 5:
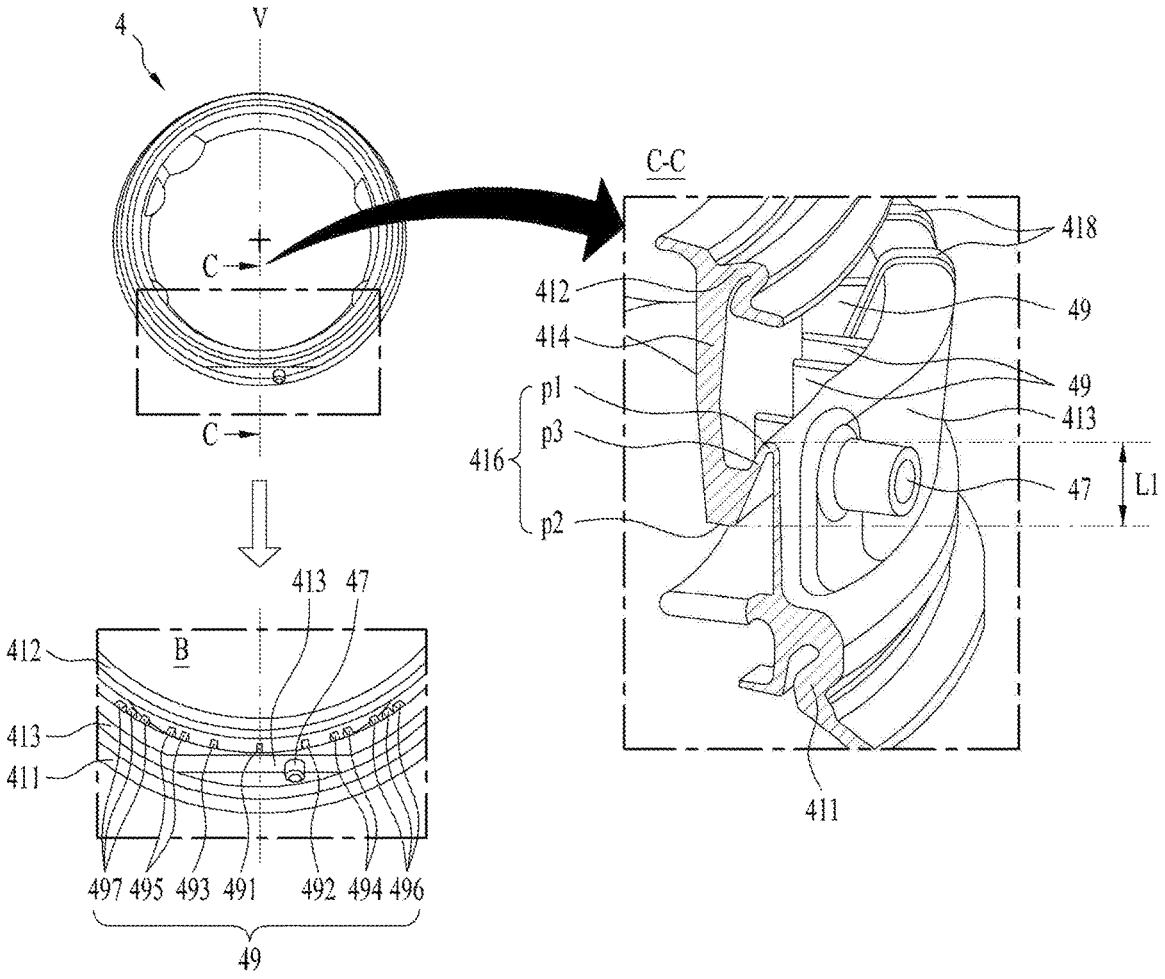
FIG. 5 shows an example of a spacer disposed in the insulator.

As shown in FIG. 5, a spacer 49 may be disposed below the horizontal line H passing through the center of the tub laundry inlet 23 to maintain a spacing between the connecting body 416 and the second extending body 414.

The spacer 49 included in the laundry treating apparatus may be embodied as an elastic body for connecting the second connecting portion P2, the third connecting portion P3, and a circumferential face of the second extending body 414 with each other. When a length of the spacer 49 is set to be too small, the connecting body 416 and the second extending body 414 may rub against each other. When the spacer 49 is too long, the insulating body 41 may have decrease in elasticity.

Therefore, the length of the spacer 49 is preferably set to be smaller than or equal to a distance L1 between the first connecting portion P1 and the second connecting portion P2 (distance between the two connecting portions in a longitudinal direction of the tub). The length of the spacer 49 may be set to be smaller than the distance L1 between the first connecting portion P1 and the second connecting portion P2 and may be set to be larger than ½ of the distance L1 between the two connecting portions.

The tub body 21 sags, and thus the tub laundry inlet 23 moves toward the base 11. Thus, the second extending body 414 located below the horizontal line passing through the center of the tub laundry inlet 23 will move toward the connecting body 416. In this connection, because, in the laundry treating apparatus, the spacer 49 is located between the second extending body 414 and the connecting body 416, the second extending body 414 and connecting body 416 may be prevented from rubbing against each other when the tub body vibrates. Further, the spacer 49 having the above-described structure has an effect of reinforcing a strength of the insulating body 41 together with the rib 418.

The spacer 49 of FIG. 5 will be described in more detail. The spacer disposed in the laundry treating apparatus may include a plurality of spacers. That is, the spacer 49 may include a first spacer 491 positioned at the vertical line V passing through the center of the tub laundry inlet, a second spacer 492 positioned on one of left and right sides to the first spacer 491 and spaced from the first spacer 491, and a third spacer 493 positioned on the other of left and right sides to the first spacer 491 and spaced from the first spacer 491. FIG. 5 shows an example in which the second spacer 492 is provided on the right side to the first spacer and the third spacer 493 is located on the left side to the first spacer.

The second spacer 492 and the third spacer 493 may be arranged to be symmetric with respect to the first spacer 491. Arranging positions of the spacers 492 and 493 to be symmetrical with respect to the first spacer 491 may allow a strength of the insulating body 41 to be evenly reinforced. This may prevent unbalanced twisting of the insulating body.

Further, the spacer 49 may further include at least one of a fourth spacer 494 located on a right side to the second spacer 492, a fifth spacer 495 located on a left side to the third spacer 493, a sixth spacer 496 located on a right side to the fourth spacer 494, or a seventh spacer 497 positioned on a left side to the fifth spacer 495.

The fourth spacer 494 may be provided at a position spaced apart from the second spacer 492. The fifth spacer 495 may be provided at a position spaced apart from the third spacer 493. The sixth spacer 496 may be provided at a position spaced apart from the fourth spacer 494. The seventh spacer 497 may be provided at a location spaced apart from the fifth spacer 495.

In this case, each of the fourth spacer 494 and the fifth spacer 495 may be configured to include two or more spacer bodies spaced apart from each other. A spacing between adjacent spacer bodies may be set such that the spacer bodies overlap each other when the second extending body 414 is pressed toward the connecting body 416. This is intended to increase the strength of the insulating body 41 and to minimize friction between the second extending body 414 and the connecting body 416.

Each of the sixth spacer 496 and the seventh spacer 497 may be configured to include three or more spacer bodies spaced apart from each other. A spacing between adjacent spacer bodies may be set such that the spacer bodies overlap each other when the second extending body 414 is pressed toward the connecting body 416.

The fourth spacer 494 and the fifth spacer 495 may be disposed at positions symmetrical with respect to the vertical line V. The sixth spacer 496 and the seventh spacer 497 may be disposed at positions symmetrical with respect to the vertical line V.

As shown in FIG. 1, water stored in the tub body 21 is discharged out of the cabinet 1 through a water discharger 6.

The water discharger 6 may include a chamber 61 to store water therein, a first water discharge pipe 63 to transfer water from the tub body 21 to the chamber 61, and a water discharge pump 65 to move the water from the chamber 61 to a second water discharge pipe 67.

The second water discharge pipe 67 may direct the water discharged from the water discharge pump 65 to the outside of the cabinet 1 and may be configured such that a highest point of the second water discharge pipe 67 passes through a point higher than the lowest point of the tub laundry inlet 23.

As shown in FIG. 2, the water discharge pump may include a first housing 651 in communication with the chamber 61 to provide a space for water storage, a first impeller 655 that is rotatable inside the first housing, a first impeller motor 657 for rotating the first impeller, and a first outlet 653 constructed to penetrate an circumferential face of the first housing and secure the second water discharge pipe 67 thereto.

In order to shorten the washing time or increase the washing power, the laundry treating apparatus 100 may further include a water ejector 7 for ejecting water stored in the tub body 21 toward the drum laundry inlet 33.

The water ejector 7 may include a channel body fixed to a front face of the tub body and located in a space between a circumferential face of the insulating body 41 and the weight 28 and 29, a supply pipe 72 to guide the water to the channel body 71, and a circulating pump 73 that moves the water inside the tub body 21 to the supply pipe 72.

The channel body 71 may be embodied as a fan-shaped channel body disposed along a space between the insulating body 41 and the first weight balancer 28 and a space between the insulating body 41 and the second weight balancer 29.

The circulating pump 73 may be configured to include a second housing 731 in communication with the chamber 61 and providing a space for water storage, a second impeller 735 provided inside the second housing, a second impeller motor 737 which rotates the second impeller, and a second outlet 733 constructed to penetrate the circumferential face of the second housing and secure the supply pipe 72 thereto.

The channel body 71 may have a first water outlet 711, a second water outlet 713, a third water outlet 715, and a fourth water outlet 717 through which water is discharged. The first water outlet 711 and second water outlet 713 may be provided on a left side to the vertical line V passing through the center of the tub laundry inlet 23. The third water outlet 715 and fourth water outlet 717 may be disposed on the right side to the vertical line V.

The first water outlet 711 may be connected to a first ejecting guide 461 provided on the first extending body 413.

The second water outlet 713 may be connected to a second ejecting guide 463 provided on the first extending body 413. The third water outlet 715 may be connected to a third ejecting guide 465 provided on the first extending body 413. The fourth water outlet 717 may be connected to a fourth ejection guide 467 provided on the first extending body 413.

As shown in FIG. 3, the ejecting guides 461, 463, 465, and 467 may be configured for guiding water respectively supplied from the water outlets 711, 713, 715, and 717 toward the drum laundry inlet 43 and may be arranged along an inner circumferential face of the first extending body 413.

As shown in FIG. 1, the laundry treating apparatus may further include a detergent supply 5 for supplying detergent to the tub 2. The detergent supply 5 may be configured to include a casing 51 disposed in the cabinet 1, and a drawer 52 withdrawable from the casing 51.

The drawer 52 housed inside the casing 51 may be drawn out of the cabinet 1 through a drawer outlet constructed to penetrate the front panel 13. The drawer 52 may have a polyhedron (a hexahedron) with an open top face. The drawer may be configured to include a storage 521 which provides a space in which a detergent is stored, and a detergent outlet 523 which communicates the storage 521 with the casing 51. The detergent outlet 523 may be embodied as a through-hole passing through a rear face or bottom face of the storage 521, or may be embodied as a bell trap formed on the bottom face of the storage 521.

The casing 51 has a water supply that supplies water to the storage 521. FIG. 1 shows an example where the water supply is fixed to a top face of the casing 51.

The water supply includes a water supply pipe 561 that supplies water from a water supply source to the storage 521, and a water supply valve 563 that opens or closes the water supply pipe 561 according to a control signal from a controller (not shown). Thus, when water is supplied to the storage 521 where the detergent is stored through the water supply pipe 561, the detergent inside the storage 521 is transferred to the casing 51 through the detergent outlet 523 together with water.

Water and detergent discharged to the casing 51 may be fed into the tub body 21 through the insulating body 41. To this end, the insulating body 41 is provided with an inflow pipe 42 into which water and detergent are introduced. The detergent supply 5 may have an outflow pipe 53 which directs the detergent and water to the inflow pipe 42.

Each of the inflow pipe 42 and the outflow pipe 53 may be made of an elastic material (rubber or the like). The inflow pipe 42 and outflow pipe 53 are designed to minimize the transmission of the vibration from the tub to the casing 51 and the front panel 15.

As shown in FIG. 3, the inflow pipe 42 may be embodied as a pipe passing through the circumferential face of the second extending body 414. In this case, on an inner circumferential face of the second extending body 414, a guide 43 for guiding water supplied through the inflow pipe 42 toward the drum laundry inlet 33 may be disposed.

As shown in FIG. 1, the outflow pipe 53 may have a trap defining pipe 531 connected thereto. The trap defining pipe 531 is configured for defining one of a P-trap, U-trap, and S-trap. In the laundry treating apparatus 100, the trap defining pipe 531 may prevent the interior of the tub body 21 from communicating with the interior of the casing 51. Thus, in the laundry treating apparatus, bubbles in the tub body may be prevented from moving to the casing 51 through the outflow pipe 53.

The water stored in the trap defining pipe 531 may move to the insulating body 41 in response to change in a pressure inside the tub body 21 that occurs when the user opens the door 135. This is because when the door 135 opens the cabinet laundry inlet 131, the pressure inside the tub body 21 will temporarily decrease.

Content stored in the trap defining pipe 531 includes water remaining in the outflow pipe 53 or a mixture of water and detergent, after completion of the water supply process or detergent supply process and thus does not cause a problems related to hygiene. However, the presence of the content may cause the user of the laundry treating apparatus to misunderstand that the detergent supply is broken.

In order to minimize such a problem, the insulator 4 may further have a connecting channel.

As shown in FIG. 3, a connecting channel 44 may be configured for directing the water discharged from the trap defining pipe 531 to a storage space 417 defined by the connecting body 416 and the first extending body 413. That is, the connecting channel 44 may be embodied as a groove defined in the second connecting portion P2 to guide water moving along a surface of the guide 43 to the storage space 417.

Liquid moving along the surface of the guide 43 at a speed below a reference speed (liquid moving at a speed below a speed at which the liquid is separated from the surface of the guide) will be transferred to the storage space 417 through the connecting channel 44 located at an edge of the guide 43. Thus, in the laundry treating apparatus, an exposure of water from the trap defining pipe 531 to the insulating body 41 may be minimized when the door 135 is opened.

In one example, the insulating body 41 has a communication pipe 47 that connects the storage space 417 to the tub body 21. The communication pipe 47 is located below the horizontal line H passing through the center of the tub laundry inlet 23. Thus, the liquid supplied to the storage space 417 through the connecting channel 44 will migrate to the tub 2 through the communication pipe 47.

The insulating body 41 located below the horizontal line H may further have an interference prevention portion for preventing interference thereof with the channel body 71. FIG. 5 shows an example where the interference prevention portion is embodied as a region parallel to the base 11 but located below the horizontal line H. In this case, the communication pipe 47 may be disposed at the horizontal line.

The communication pipe 47 may be located at the vertical line V passing through the center of the tub laundry inlet or may be disposed at a position away from the vertical line V. FIG. 5 shows a case where the communication pipe 47 is located at a position spaced apart from the vertical line V. This results from a configuration that the supply pipe 72 of the water ejector 7 is placed at the vertical line V as described above.

The laundry treating apparatus may be embodied in various forms. Effects as not described herein may be derived from the above configurations. The relationship between the above-described components may allow a new effect not seen in the conventional approach to be derived.

In addition, embodiments shown in the drawings may be modified and implemented in other forms. The modifications should be regarded as falling within a scope of the present disclosure when the modifications is carried out so as to include a component claimed in the claims or within a scope of an equivalent thereto.

What is claimed is:

1. A laundry treating apparatus comprising:

a cabinet defining a cabinet laundry inlet;

a tub configured to receive water and defining a tub laundry inlet facing the cabinet laundry inlet;

a drum rotatably disposed in the tub and configured to receive laundry therein;

a first fixed body mounted to the tub and configured to at least partially surround the tub laundry inlet;

a second fixed body mounted to the cabinet and configured to at least partially surround the cabinet laundry inlet;

a first extending body including a first cylindrical elastic body extending from the first fixed body toward the second fixed body;

a second extending body including a second cylindrical elastic body extending from the second fixed body toward the first fixed body, the second extending body having a free end configured to be inserted into the first extending body;

a connecting body including:

a first connecting portion including a first curved elastic portion extending from a free end of the first extending body toward the second extending body, a second connecting portion including a second curved elastic portion extending from the free end of the second extending body toward the first extending body, and a third connecting portion including an elastic portion connecting the first connecting portion to the second connecting portion; and one or more spacers configured to maintain a space between the connecting body and the second extending body, wherein the one or more spacers include an elastic body that connects the second connecting portion, the third connecting portion, and the second extending body with each other, and wherein the one or more spacers extend from the second connecting portion toward the first connecting portion.

2. The laundry treating apparatus of claim 1, wherein the one or more spacers are positioned vertically below a horizontal plane that includes a rotational axis of the drum.

3. The laundry treating apparatus of claim 1, wherein the one or more spacers are sized to be smaller than or equal to a space between the first connecting portion and the second connecting portion.

4. The laundry treating apparatus of claim 3, wherein the one or more spacers are sized to be smaller than the space between the first connecting portion and the second connecting portion and greater than ½ of the space.

5. The laundry treating apparatus of claim 3, wherein at least one of the first fixed body, the second fixed body, the first extending body, the second extending body, the first connecting portion, the second connecting portion, the third connecting portion, or the one or more spacers is made of rubber.

6. The laundry treating apparatus of claim 3, further comprising:

an inflow pipe configured to be connected to the second extending body;

a storage disposed in the cabinet and configured to store detergent therein;

a detergent outlet configured to discharge the detergent from the storage;

an outflow pipe configured to connect the detergent outlet and the inflow pipe; and a trap defining pipe configured to provide at least one of a P-trap, a U-trap, or an S-trap between the detergent outlet and the inflow pipe.

7. The laundry treating apparatus of claim 6, further comprising:

a guide mounted to the second extending body and configured to guide liquid discharged from the inflow pipe toward the tub laundry inlet;

a connecting channel configured to connect a storage space to the guide, the storage space defined by the connecting body and the first extending body; and a communication pipe configured to connect the storage space to the tub and permit for liquid inside the storage space to flow into the tub.

8. The laundry treating apparatus of claim 7, wherein the connecting channel includes a groove defined in the second connecting portion and configured to guide water to move along a surface of the guide into the storage space.

9. A laundry treating apparatus comprising:

a cabinet defining a cabinet laundry inlet;

a tub configured to receive water and defining a tub laundry inlet facing the cabinet laundry inlet;

a drum rotatably disposed in the tub and configured to receive laundry therein;

a first fixed body mounted to the tub and configured to at least partially surround the tub laundry inlet;

a second fixed body mounted to the cabinet and configured to at least partially surround the cabinet laundry inlet;

a first extending body including a first cylindrical elastic body extending from the first fixed body toward the second fixed body;

a second extending body including a second cylindrical elastic body extending from the second fixed body toward the first fixed body, the second extending body having a free end configured to be inserted into the first extending body;

a connecting body including:

a first connecting portion including a first curved elastic portion extending from a free end of the first extending body toward the second extending body, a second connecting portion including a second curved elastic portion extending from the free end of the second extending body toward the first extending body, and a third connecting portion including an elastic portion connecting the first connecting portion to the second connecting portion; and one or more spacers configured to maintain a space between the connecting body and the second extending body, wherein the one or more spacers are positioned vertically below a horizontal plane that includes a rotational axis of the drum, and wherein the one or more spacers include:

a first spacer positioned on a vertical plane including the rotational axis of the drum;

a second spacer positioned at a first side from the vertical plane and spaced apart from the first spacer; and a third spacer positioned at a second side from the vertical plane and spaced apart from the first spacer, the second side being opposite to the first side with respect to the vertical plane, wherein the second spacer and the third spacer are symmetrically disposed with respect to the first spacer.

10. The laundry treating apparatus of claim 9, wherein the one or more spacers further include:

a plurality of fourth spacers positioned at the first side from the vertical plane and spaced apart from the second spacer, wherein the plurality of fourth spacers are spaced apart from each other; and a plurality of fifth spacers positioned at the second side from the vertical plane and spaced apart from the third spacer, wherein the plurality of fifth spacers are spaced apart from each other.

11. The laundry treating apparatus of claim 10, wherein the one or more spacers further include:

three or more sixth spacers positioned at the first side from the vertical plane and spaced apart from the plurality of fourth spacers, wherein the three or more sixth spacer are spaced apart from each other; and three or more seventh spacers positioned at the second side from the vertical plane and spaced apart from the plurality of fifth spacers, wherein the three or more seventh spacers are spaced apart from each other.

12. The laundry treating apparatus of claim 1, wherein the cabinet includes a door configured to open and close the cabinet laundry inlet.

13. The laundry treating apparatus of claim 1, wherein the drum defines a drum laundry inlet facing the tub laundry inlet.

14. The laundry treating apparatus of claim 1, wherein the first extending body defines a first inner diameter, and the second extending body defines a second inner diameter being smaller than the first inner diameter.

15. A laundry treating apparatus comprising:

a cabinet defining a cabinet laundry inlet;

a tub configured to receive water and defining a tub laundry inlet facing the cabinet laundry inlet;

a drum rotatably disposed in the tub and configured to receive laundry therein;

a first fixed body mounted to the tub and configured to at least partially surround the tub laundry inlet;

a second fixed body mounted to the cabinet and configured to at least partially surround the cabinet laundry inlet;

a first extending body extending from the first fixed body toward the second fixed body, the first extending body having a first end;

a second extending body extending from the second fixed body toward the first fixed body, the second extending body having a second end configured to be inserted into the first extending body such that the first end of the first extending body surrounds the second extending body;

an elastic connecting body configured to connect the first end of the first extending body with the second end of the second extending body; and one or more spacers configured to maintain a space between the connecting body and the second extending body, wherein the one or more spacers include:

a first spacer positioned on a vertical plane including a rotational axis of the drum;

a second spacer positioned at a first side from the vertical plane and spaced apart from the first spacer; and a third spacer positioned at a second side from the vertical plane and spaced apart from the first spacer, the second side being opposite to the first side with respect to the vertical plane, wherein the second spacer and the third spacer are symmetrically disposed with respect to the first spacer.

16. The laundry treating apparatus of claim 15, wherein the one or more spacers are positioned vertically below a horizontal plane that includes a rotational axis of the drum.

17. The laundry treating apparatus of claim 15, wherein at least one of the first fixed body, the second fixed body, the first extending body, the second extending body, or the one or more spacers is made of rubber.

18. The laundry treating apparatus of claim 15, wherein the one or more spacers further include:

a plurality of fourth spacers positioned at the first side from the vertical plane and spaced apart from the second spacer, wherein the plurality of fourth spacers are spaced apart from each other; and a plurality of fifth spacers positioned at the second side from the vertical plane and spaced apart from the third spacer, wherein the plurality of fifth spacers are spaced apart from each other.

19. The laundry treating apparatus of claim 18, wherein the one or more spacers further include:

three or more sixth spacers positioned at the first side from the vertical plane and spaced apart from the plurality of fourth spacers, wherein the three or more sixth spacer are spaced apart from each other; and three or more seventh spacers positioned at the second side from the vertical plane and spaced apart from the plurality of fifth spacers, wherein the three or more seventh spacers are spaced apart from each other.

20. The laundry treating apparatus of claim 1, wherein the one or more spacers include:

a first spacer positioned on a vertical plane including a rotational axis of the drum;

a second spacer positioned at a first side from the vertical plane and spaced apart from the first spacer; and a third spacer positioned at a second side from the vertical plane and spaced apart from the first spacer, the second side being opposite to the first side with respect to the vertical plane, wherein the second spacer and the third spacer are symmetrically disposed with respect to the first spacer.

* * * * *